US005435136A

United States Patent [19]

Ishizaki et al.

[11] Patent Number: 5,435,136

[45] Date of Patent: * Jul. 25, 1995

[54] PULSE TUBE HEAT ENGINE

[75] Inventors: Yoshihiro Ishizaki, Kamakura; Takayuki Matsui, Fujisawa, both of Japan

[73] Assignees: Aisin Seiki Kabushiki Kaisha, Kariya; ECTI Kabushiki Kaisha, Kamakura, both of Japan

[ * ] Notice: The portion of the term of this patent subsequent to Dec. 14, 2010 has been disclaimed.

[21] Appl. No.: 960,837

[22] Filed: Oct. 14, 1992

[30] Foreign Application Priority Data

| | | | |
|---|---|---|---|
| Oct. 15, 1991 | [JP] | Japan | 3-266181 |
| Nov. 22, 1991 | [JP] | Japan | 3-332802 |
| Nov. 22, 1991 | [JP] | Japan | 3-332803 |
| Nov. 22, 1991 | [JP] | Japan | 3-332804 |
| Nov. 22, 1991 | [JP] | Japan | 3-332805 |

[51] Int. Cl.[6] ..... F25B 9/00

[52] U.S. Cl. ..... 60/517; 62/6; 62/467

[58] Field of Search ..... 60/517; 62/6, 467, 401

[56] References Cited

U.S. PATENT DOCUMENTS

| | | | |
|---|---|---|---|
| 4,024,727 | 5/1977 | Berry et al. | 62/6 |
| 4,335,579 | 6/1982 | Sugimoto | 62/6 |
| 4,570,445 | 2/1986 | Ishibashi et al. | 62/6 |
| 4,717,405 | 1/1988 | Budliger | 60/517 |
| 5,172,554 | 12/1992 | Swift et al. | 60/520 |
| 5,269,147 | 12/1993 | Ishizaki et al. | 62/467 |
| 5,275,002 | 1/1994 | Inoue et al. | 62/467 |

FOREIGN PATENT DOCUMENTS

| | | | |
|---|---|---|---|
| 76774 | 4/1986 | Japan . | |
| 225556 | 10/1986 | Japan . | |
| 228266 | 10/1986 | Japan . | |
| 175560 | 8/1987 | Japan . | |
| 194260 | 12/1988 | Japan . | |
| 142366 | 6/1989 | Japan . | |
| 200158 | 8/1989 | Japan . | |
| 280668 | 11/1989 | Japan . | |
| 282161 | 12/1991 | Japan | 62/6 |

OTHER PUBLICATIONS

Inoue, Low Temperature Engineering, vol. 26, No. 2, 1991, pp. 98–107. "Current State of Research of Pulse-Tube Refrigerators".

Radebaugh, Advances in Cryogenic Engineering, vol. 35, 1990, pp. 1191–1205.

Radebaugh, et al., Fourth International Cryocooler Conference, 1987, pp. 119–133. "Refrigeration Efficiency of Pulse-Tube Refrigerators".

Matsubara, et al., The 5th International Cryocooler Conference, pp. 127–135. "Alternative Methods of the Orifice Pulse Tube Refrigerator".

Kasuya, et al., Cryogenics, vol. 31, No. 9, 1991, pp. 786–790. "Work and heat flows in a pulse-tube refrigerator".

*Primary Examiner*—Edward K. Look

*Assistant Examiner*—James A. Larson

*Attorney, Agent, or Firm*—Oblon, Spivak, McClelland, Maier & Neustadt

[57] ABSTRACT

A pulse tube refrigerator includes a compression space defined by a compression piston inside a cylinder, an expansion space defined by an expansion piston inside a cylinder, the expansion piston being reciprocated at an advance angle of a constant phase difference within a range of 10°–45° relative to the compression piston, and first and second thermal systems communicating the compression and expansion spaces. Each thermal system has a radiator, a regenerator, a cold head and a pulse tube, with the regenerator of the second thermal system being composed of two regenerator sections. The cold head of the first thermal system is made to perform a heat exchange with the second thermal system between the two regenerator sections thereof, whereby a very low temperature is obtained from the cold head of the second thermal system.

8 Claims, 13 Drawing Sheets

PULSE TUBE HEAT ENGINE

BACKGROUND OF THE INVENTION

1. Field of the Invention

This invention relates to a pulse tube heat engine which makes it possible to provide a simply structured, highly efficient, highly reliable and low-cost refrigerator or prime mover, wherein a pulse tube, which is the main device used in the adiabatic process of a pulse tube refrigerator, is introduced in a Stirling-cycle engine to construct a thermal cycle (a pseudo-Stirling cycle) comprising, in terms of theoretical operation, two isovolumetric processes and two adiabatic processes, whereby an expansion piston or a displacer, reciprocated at low or high temperature and heretofore essential in refrigerators or prime movers of a Stirling engine, is no loner necessary.

2. Description of the Prior Art

A Stirling cycle comprising two isothermal and isovolumetric processes is a closed-cycle apparatus which uses a working fluid (helium, argon, hydrogen, etc.) and has been developed as an external-combustion engine or refrigerator. A drawback encountered in refrigerators which use this Stirling cycle is that mechanical vibration, which is produced by reciprocation of a low-temperature, comparatively long expansion piston, is transmitted to a cold head and causes a sensor or the like to generate noise. Another problem is that contact between the outer peripheral surface of the comparatively long expansion piston and the inner peripheral surface of a cylinder produces abrasion dust that contaminates the working fluid and a regenerator. This leads to malfunctions and a decline in the performance of the refrigerator.

In order to eliminate these disadvantages of refrigerators which employ the Stirling cycle, a pulse tube refrigerator was disclosed in Low-Temperature Engineering, Vol. 26, No. 2 (1991) by Tatsuo Inoue. In this system, a radiator, a regenerator, a cold head, a pulse-tube and an orifice are serially connected between a compression space and a buffer tank to produce low temperatures using a working gas such as helium as the medium.

A pulse tube refrigerator was first proposed by W. E. Gifford in 1963. This low-temperature generating system features simply arranged component parts and, since it does not possess moving parts in its low-temperature section, there is no mechanical vibration in the heat absorber (also referred to as a cold head). For these reasons, expectations were high that it would find practical use as a highly reliable refrigerator. However, since the low-temperature generating system employs an operating principle based upon the characteristic of the non-equilibrium state of a working fluid, it is difficult to derive equations in the actual operating state and analyze the operating cycle. In addition, though the technical paper has been published from thermoacoustic and other viewpoints, there are many approximations of conditions and the principle of operation has not been established theoretically. Moreover, though efficiency is low in actual practice, it has proven that low-temperature generation is possible.

Though the principle of operation will not be touched upon here, it is clear that a simply shaped pulse tube, which is a hollow cylindrical tube made of metal or a composite material, is the main element among the component parts of the cycle, and that this tube bears the burden of the adiabatic process. In the operation of the cycle, it is believed that low temperatures are generated owing to a shift in the phase of a pressure change within the pulse tube when a fluid travels within a compression space and buffer tank.

The merit of this system is that even though operation as a prime mover is impossible solely with this engine arrangement, low temperatures can be generated without using an expansion piston reciprocated at low temperature.

This invention is concerned with a novel Stirling-cycle heat engine in which the above-mentioned pulse tube is introduced in the component parts of the Stirling cycle, described later.

The Stirling cycle is an ideal cycle theoretically comprising two isothermal processes and two isovolumetric processes. In an actual working engine, the engine is of the closed-cycle type in which helium or hydrogen is used as the working fluid (hereinafter referred to simply as the "fluid", other examples of which are neon, argon, nitrogen, air or mixed gases). In operation as a refrigerator, efficiency is higher than that of all other refrigeration cycles. Even in operation as a prime mover, it is known that vibratory noise is lower and efficiency higher in comparison with other engines.

In the meantime, a structural feature of the pulse tube refrigerator is use of a cylindrical pulse tube consisting of a metal or ceramic or a composite material thereof. During a refrigerating operation, this pulse tube exhibits a comparatively large temperature gradient and bears the burden of the adiabatic effect. However, it is well known that a refrigerator using a pulse tube is not always efficient.

Use as a refrigerator will be described with reference to FIG. 1, which shows the structure of a kinematic Stirling cycle, and FIG. 2, which illustrates P-V and T-S curves.

As illustrated in FIG. 1, a compression space 1 is connected to a crankshaft 2 driven by a motor, which is not shown. The volume of the compression space 1 is capable of being varied in a compression cylinder 4 by a connecting rod 12 and a reciprocating compression piston 3. A radiator 5, a regenerator 6 and a heat absorber 7 (in case of a prime mover, this is also referred to as a high-temperature heat exchanger or heater raised to a temperature of 900 to 1000 K as by a flame) are connected between the compression space 1 and an expansion space 10, which is defined by an expansion cylinder 8 and an expansion piston 9. In the compression space 1, a phase difference in the varying volume is advanced while maintaining a constant phase-angle difference within a range of 70° to 110° (the optimum phase difference is approximately 90°). As for the principle of operation, theoretically the fluid in the compression space 1 is compressed isothermally while giving off heat in the radiator 5 (this is an isothermal compression process, indicated at a-$b_1$ in FIG. 2). Next, the compression piston 3 moves toward top dead center, as a result of which the fluid is cooled to 30 K (−243° C.) by the regenerating material of the regenerator 6. The 1 cooled fluid enters the heat absorber 7 and then the expansion chamber 10 at a fixed volume (this is an isovolumetric process, indicated at $b_1$-c). Next, since the fluid performs the work of urging the expansion piston 9, it is recovered as effort by the crank 2 via the connecting rod 12. (This is an isothermal expansion process, indicated at c-$d_1$, in which the foregoing occurs while heat is being absorbed from the object to be cooled, i.e., while the object is being cooled, by the heat absorber 7.) Finally, the fluid which has performed the work of expansion and resides in the expansion space 10 that is presently of maximum volume is forcibly returned to the compression space 1 from the regenerator 6 and radiator 5 as the expansion piston 9 is moved from bottom dead center to top dead center (this is an isovolumetric process, indicated at $d_1$-a), This ends one cycle. In FIG. 1, numeral 11 denotes a piston ring.

A disadvantage of this refrigerator (and of the prime mover as well) is that the expansion piston 9 contacts the expansion cylinder 8 and also resonates owing to the reciprocating motion of the expansion piston, which is comparatively long (35–45 cm, inclusive of a guide piston, not shown, in a case where there is one expansion space and the refrigeration output is 200 W at 80 K). As a result, mechanical vibration is produced, and this has a deleterious effect upon the object to be cooled by the heat absorber 7. For example, if this vibration is transmitted to an electronic sensor, the sensor will produce noise. Though there are displacer-type Stirling engines, inclusive of refrigerators and prime movers, in which mechanical vibration is reduced by arranging it so that the expansion piston 9 performs no work, dimensional precision deteriorates owing to large changes in temperature. Consequently, even if the comparatively long displacer, which is subjected to high or extremely low temperatures during use, is fabricated to have a high mechanical precision, contact accidents frequently occur during reciprocation. As a result, mechanical vibration is produced, and dust and gases caused by the breakdown thereof are produced owing to the contact wear of the displacer. The fluid thus becomes contaminated, leading to a decline in performance. Furthermore, the regenerator 6, which comprises innumerable small balls or a wire mesh, can become clogged owing to the dust or the mixture of impure gases and fluid (in a refrigerator, condensation and solidification of gases having a high boiling point can occur). Moreover, manufacturing costs are very high for the expansion pistons or displacers, which require a high manufacturing precision, for the finishing of the inner wall surface of the relevant cylinders, and for the manufacturing cost of the drive mechanism. As a result, use of a comparatively long expansion cylinder or displacer leads to a decline in the reliability of the Stirling engine.

SUMMARY OF THE INVENTION

Accordingly, an object of the present invention is to provide a reversible heat engine of the pulse-tube type, in which the aforementioned drawbacks are eliminated.

According to the present invention, the foregoing object is attained by providing a pulse tube heat engine comprising a compression space, a radiator, a regenerator, a heat absorber, a pulse tube and an expansion space, wherein the components are so arranged that the heat engine operates as a prime mover in which the radiator, the regenerator, the heat absorber and the pulse tube are connected between the compression space and the expansion space of a working fluid, or a heat exchanger is connected about the periphery of the expansion space, and a variation in the volume of the expansion space is advanced by a constant phase difference within a range of phases of from 0° to +60° relative to a variation in the volume of the compression space.

In accordance with the present invention as described above, the heat engine can function as a highly efficient prime mover, refrigerator or heat pump.

According to the present invention, the foregoing object is further attained by providing a pulse tube refrigerator in which means comprising a combination of a pulse tube and a cold expansion piston basically is used in place of the pulse tube, orifice and buffer tank employed conventionally.

More specifically, the present invention provides a pulse tube refrigerator comprising a compression space defined by a compression piston inside a cylinder, an expansion space defined by an expansion piston inside a cylinder, the expansion piston being reciprocated at an advance angle of a constant phase difference within a range of 10°–45° relative to the compression piston, and first and second thermal systems communicating the compression and expansion spaces and each having a radiator, a regenerator, a cold head and a pulse tube, wherein a heat exchange is performed between the cold head of the first thermal system and the cold head of the second thermal system.

In accordance with the present invention, a novel operation is performed in which the pulse tube is made to act as a static gas piston for the adiabatic expansion process in the Stirling cycle along with the cold expansion piston.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Preferred embodiments of the present invention will now be described with reference to the drawings.

Figure 2:
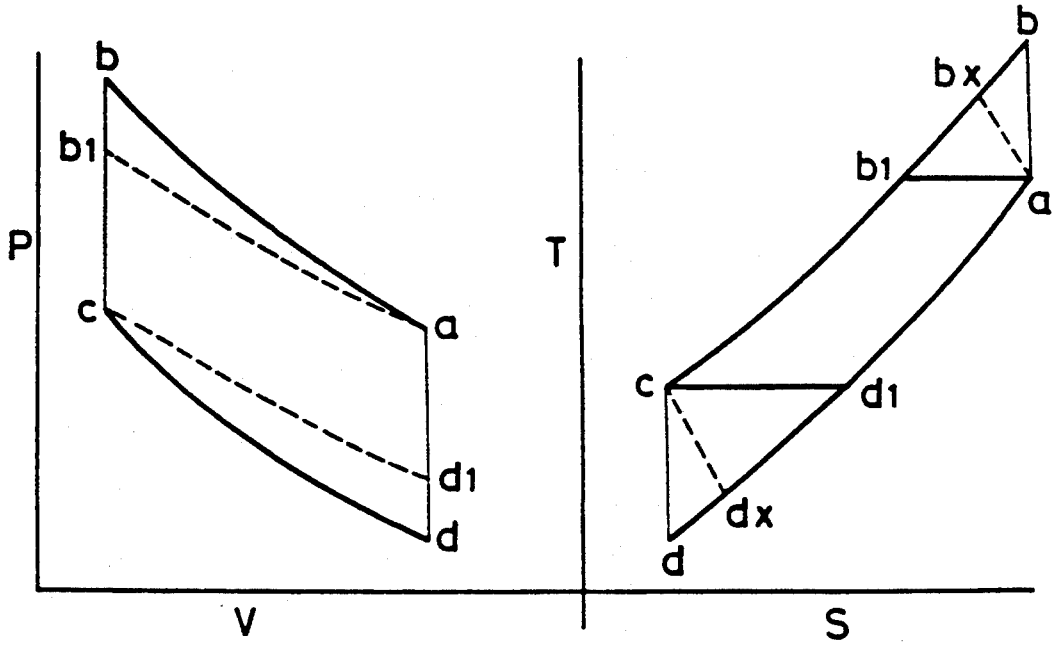
FIG. 2 shows diagrams of a P-V curve and T-S curve.
Figure 3:
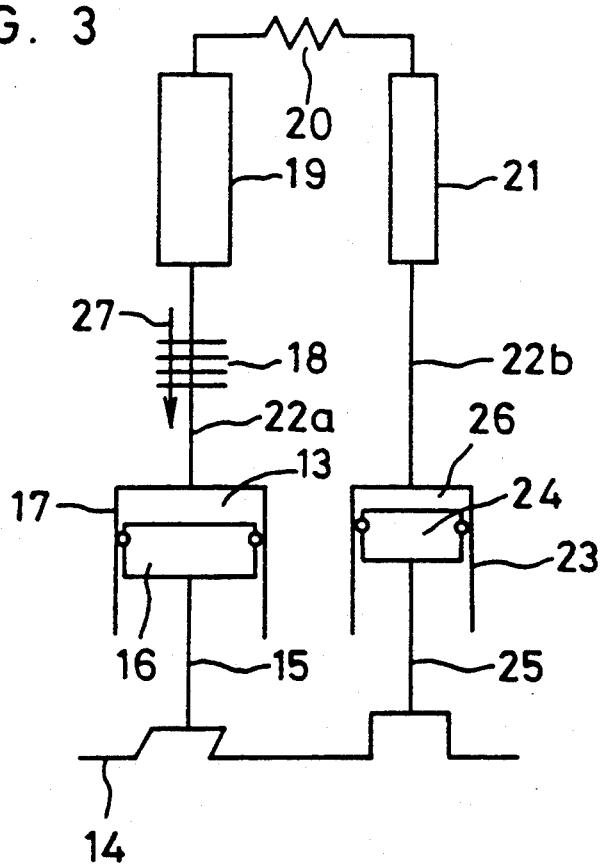
FIG. 3 is a diagram showing the flow path and sectional structure of a pulse heat engine according to one embodiment of the present invention.

FIG. 3 illustrates an embodiment relating to the flow path and sectional structure of a pulse tube heat engine according to the present invention, the purpose of which is to simplify the structure of the elements constituting the engine. Though the T-S curve of FIG. 2 can be cited as an example of the thermodynamic operating process, theoretically the engine is a pseudo-Stirling-cycle heat engine comprising two adiabatic processes (a-b, c-d) and two isovolumetric processes (b-c, d-a). Actual operation is accompanied by partial irreversible stages, so that the transitions are as indicated by the dashed lines ($a$-$b_x$, $c$-$d_x$).

Figure 1:
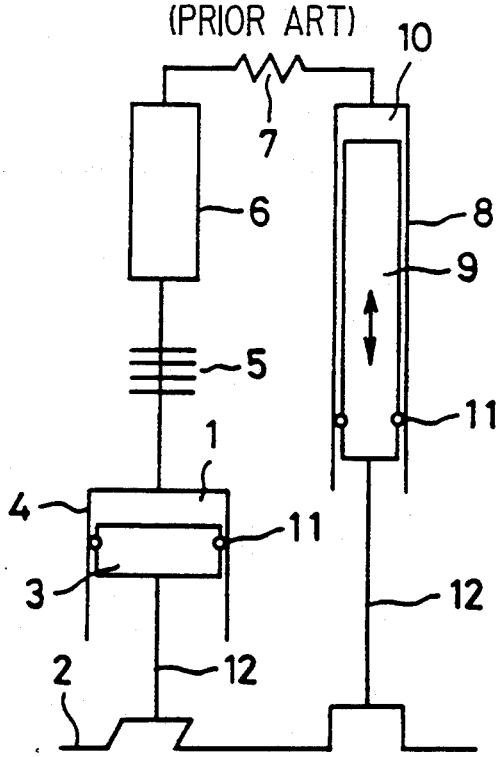
FIG. 1 (PRIOR ART)
FIG. 1 is a diagram illustrating the structure of a kinematic Stirling cycle.

A major advantage of this heat engine is the elimination of the expansion cylinder 8 and the expansion piston 9, which is reciprocated at high temperature or very low temperature in the Stirling engine of FIG. 1. Instead, a pulse tube 21, which is assumed to undergo the adiabatic process in a pulse tube refrigerator, is introduced into the components of the cycle, and this is made to operate as a gas piston in place of the solid piston of a Stirling engine owing to the synergistic function of the pulse tube and an expansion space 26, which relies upon an ordinary-temperature (cold) piston 24, thereby achieving the adiabatic and expansion processes. As a result, cold portions such as the expansion space 10 and crank mechanism in FIG. 1, the piston reciprocated at high temperature or very low temperature, and the need for long distances for adiabatic purposes in the other items of equipment are eliminated. In this way all of the drawbacks of the earlier Stirling engine are eliminated.

An embodiment in which the present invention is applied to a refrigerator will now be described.

As shown in FIG. 3, a fluid compression space 13 is formed by a cylinder 17 and a compression piston 16 mechanically reciprocated, via a connecting rod 15 and a guide piston (not shown), by rotation of a crankshaft 14 driven by a motor or the like which is not shown. (Since it acts as a compressor not having a discharge valve and an intake valve, the compression space 13 is also referred to as compression chamber. The compression space 13 is not limited to a piston cylinder but can also be formed by a diaphragm, bellows or the like.) An expansion space 26 is formed by a cold expansion cylinder 23 and an expansion piston 24, which is connected to the crankshaft 14 via a rod 25 and a guide piston, not shown. The cold expansion cylinder 23 operates a fixed phase difference in advance of the volumetric change in the compression space 13. This fixed phase difference lies within a range of 0° to 60° relative to the volumetric change in the compression space 13 (the optimum phase difference is approximately 20°). (This differs depending upon the operating conditions and is referred to also as a phase angle difference or crank angle, wherein the system runs while the volumetric change in the expansion space is maintained a fixed phase difference ahead of the volumetric change in the compression space.) The compression space 13 and the expansion space 26 are connected via an air-cooled or liquid-cooled (27) radiator 18, a regenerator 19 filled with a regenerator comprising a mesh made of stainless steel or bronze, innumerable small lead balls or a rare-earth element, a heat absorber (also referred to as a cold head) 20 for generating low temperature by refrigerating a medium to be cooled, and a pulse tube 21.

Figure 4:
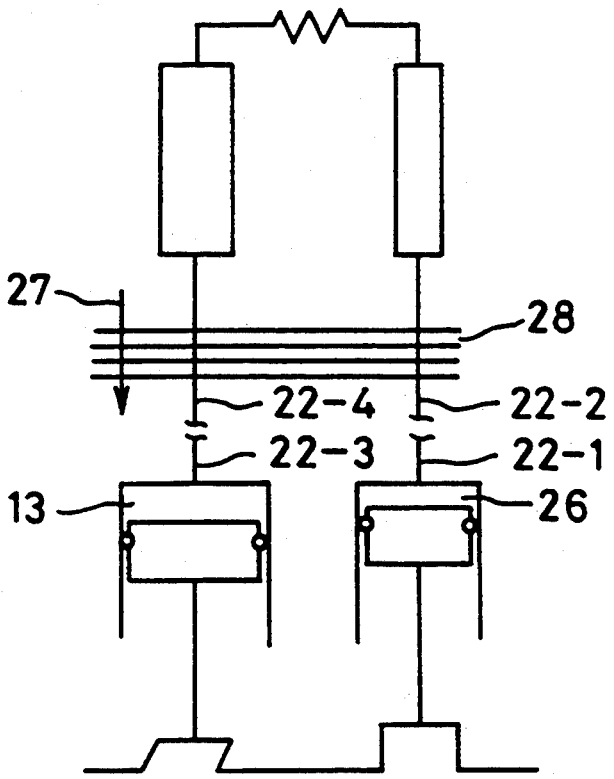
FIG. 4 is a diagram showing the flow path and sectional structure of a pulse heat engine according to another embodiment of the present invention.

Alternatively, as shown in FIG. 4, the pulse tube 21 and the expansion space 26 can be connected via a heat exchanger 28 manufactured as an integral part of the radiator 18 of FIG. 3. The heat exchanger 28 prevents the temperature of the fluid from falling below that of the cold expansion space 26 owing to irreversibility generated in the adiabatic and expansion processes. At the same time, the heat exchanger 28 absorbs a part of the load 27 of the heat ejected at the radiator 18. Mechanical vibration at the heat absorber 20 can be completely eliminated if piping 22-1, 22-2 between the expansion space 26 and heat exchanger 28 and piping 22-3, 22-4 between the compression space 13 and heat exchanger 28 are made flexible.

In FIG. 3, the distance between the compression space 13 and the expansion space 26 is short since these are formed by the same crankcase, not shown. If concentrically arranged double pipes are adopted as piping **22*a*, 22*b* in FIG. 3 is made, these pipes will each perform a heat exchange to provide an effect the same as that of the heat exchanger 28**. Moreover, in apparent terms, the piping system can be made a single pipe, so that the overall apparatus can be made more compact.

Operation in an ideal operating state will be described with reference to the T-S and P-V curves in FIG. 2, and to FIG. 3. The fluid in the compression space 13 is compressed (the adiabatic compression process) isentropically from point a of ordinary temperature and attains point b of high temperature and pressure. Next, in the constant-volume stage, heat is given off to the coolant 27 of the cold portion at the heat exchanger 18, whereby point $b_1$ is attained, and the fluid enters the regenerator 19 where it is cooled from point $b_1$ to point c. This is the isovolumetric process. Next, when the expansion piston 24 moves toward bottom dead center, the fluid in the regenerator 19 and heat absorber 20 expands as the fluid in the pulse tube 21 and expansion space 26 performs work by urging the piston 24 so as to turn the crankshaft 14, and hence the point d is attained. This is the adiabatic expansion process, in which volume is maximized. The fluid in the expansion space 26 then flows through the piping **22*b* isovolumetrically and, together with the fluid in the pulse tube 21, cools the object (not shown) to be cooled ($d$-$d_1$) via the heat absorber 20. The fluid flows into the regenerator 19 and radiator 18, is warmed from point $d_1$ to point a, and then returns to the compression space 13** (this is the isovolumetric process), thereby ending one cycle. The actual operating process is accompanied by partial irreversible stages, so that the transitions are as indicated by the dashed lines at $a$-$b_x$, $c$-$d_x$.

In operation as a prime mover, each process on the T-S curve is the reverse of that which prevails in a refrigerator, and the processes are adiabatic compression (d-c) and the isovolumetric stage (c-b), with point a serving as the ordinary temperature. However, heating is performed up to 700–1000 K, from point $b_1$ to point b, in the heat absorber 20. Next, adiabatic expansion takes place, power is generated (the adiabatic expansion process, indicated at b-a), and power is obtained from the crank shaft 14. Finally, the fluid is returned to the compression space 13 in the isovolumetric process of a-d, and one cycle ends.

The volume of the expansion space at this time is within a range of 50% to 120% of the compression space. The higher the temperature of the heat absorber 20 (also referred to as a high-temperature heat exchanger or heater tube), the larger the volume can be made. Efficiency also rises with a increase in output. It should be noted that these processes are polytropic processes accompanied by inefficiency at the time of actual operation. If expressed by a P-V curve, the acute-angle portions in each process would be shaved off and smoothened.

Figure 5:
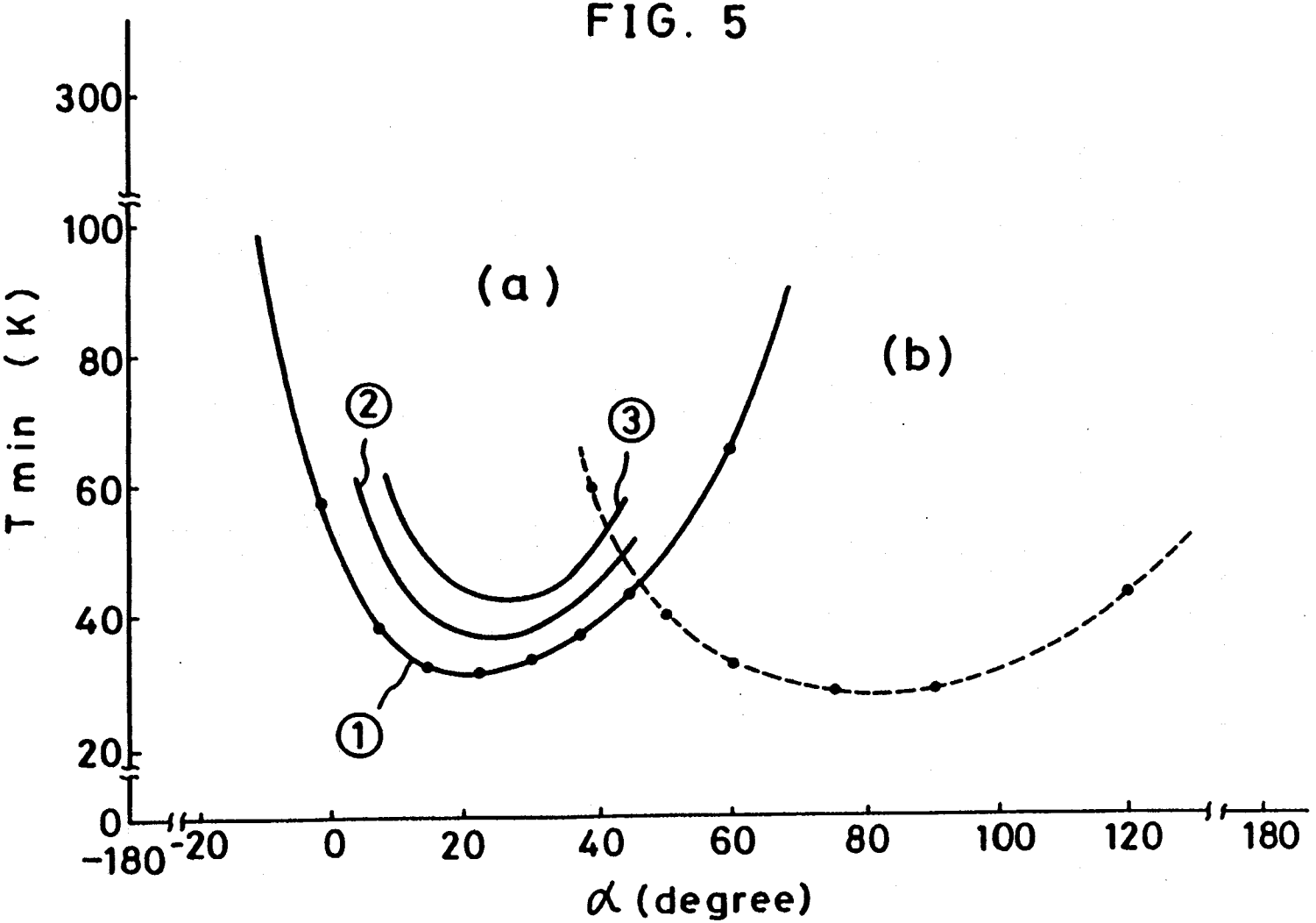
FIG. 5 illustrates a curve (a) of the relationship between a phase difference ($\alpha$) and minimum attained temperature ($T_{min}$), which were obtained by testing a refrigerator realized by the heat engine of the present invention, and a curve (b) of the relationship between the phase difference ($\alpha$) and minimum attained temperature ($T_{min}$) in a split Stirling-cycle refrigerator.

Reference will be made to FIG. 5 to compare a curve (a) of the relationship between a phase difference ($\alpha$) and minimum attained temperature ($T_{min}$), which were obtained by testing a refrigerator realized by the heat engine of the present invention, and a curve (b) of the relationship between the phase difference ($\alpha$) and minimum attained temperature ($T_{min}$) in a split Stirling-cycle refrigerator.

In the present invention, the optimum phase difference is 20°, and the regenerator consists solely of a bronze mesh. Even through the minimum temperature attained differs depending upon the specifications of the equipment and the operating conditions, this temperature is 33 K, 38 K and 42 K when the volume of the expansion space is 10%, 15% and 20% that of the compression space, as indicated by curves (1), (2) and (3), respectively, in FIG. 5. Maximum efficiency can be obtained within −15° and +25°, taking 20° as the center. In other words, the phase-difference angle can be obtained within a range of from 5° to 45°. In FIG. 5, the temperature attained is about 33 K, as indicated by curve (1). The phase-angle difference at this time is 20°. The range of phase angles over which low temperatures are capable of being generated is from 0°, i.e., the same phase, to 60°. This means that this range. This means that the $T_{min}$ obtained as an adequate refrigeration output is obtained within 20° is departed and 60° is approached gently rises so that both efficiency and refrigeration output decrease. The curve from less than 20° to −5° defines an acute angle, so that the refrigeration output suddenly declines. When −15° is attained, $T_{min}$ suddenly increases and rises above 100 K, though this is not shown.

In the operation of the refrigerator based upon The heat engine of this invention, −5° is the limit of values below 0°. This means that a refrigeration output cannot be sufficiently obtained below this value. In the Stirling cycle (b) of FIG. 5, the optimum phase angle is approximately 90° and the range is ±30° (60°-120°) about this angle as center. Thus, generation of low temperature is possible over a range wider than that of the engine according to this invention. Moreover, a refrigeration output is obtained over a gentle curve. However, efficiency within a range of 90°±10° is high, though this differs depending upon the operating conditions. In a Stirling prime mover also, it is known that the phase difference $\alpha$ is similar and that maximum efficiency is obtained at approximately 90°.

Thus, in accordance with the present invention as described above, an adequate low temperature is attained even though an expansion piston or displacer reciprocated at low temperature is eliminated, and it is clear also from the relationship the phase difference ($\alpha$) and minimum attained temperature (Tmin) in FIG. 5 the present invention is thermodynamically different from existing Stirling engines.

Though the pulse tube 21 can be made of a composite or ceramic material, use mainly is made of a hollow circular cylindrical tube consisting of a material such as stainless steel which is a poor conductor of heat. For refrigeration power of 100 W at 77 K, tube length is 25–32 cm and inner diameter is 2.5 cm±0.5 cm. Though not shown, there are cases where a fluidic rectifier comprising a mesh or the like is provided in the inlet and outlet. In a prime mover, the rectifier on the side of the expansion space 26 is cooled. There are also cases where a plurality of pulse tubes are used in parallel, as when the engine is increased in size or its speed is raised. In terms of shape, the pulse tube is not limited to circular tube, for it is possible to employ a pulse tube which is elliptical, triangular or conical in shape. However, the circular tube is convenient since its wall thickness can be reduced if the fluid is raised to a high pressure. As a result, heat-intrusion loss from ordinary temperature is reduced.

The volume of the expansion space 26 is within a range of 6.6–30% of the volume of the compression space 13 in the refrigerator, i.e., the volume of the compression space is 3 to 15 times that of the expansion space, and it is possible to produce low temperatures highly efficiently by the refrigeration temperature. The lower the required refrigeration temperature, the closer the volume is to 6.6%. The ideal ratio differs depending upon the refrigeration temperature at the heat absorber 20 and the output. Furthermore, the ideal ratio differs depending upon such operating conditions as the mean operating pressure of the fluid, rpm and phase difference, as well as the piping length (dead volume and pressure loss within the piping).

The ratio of the expansion space 26 to the compression space 13 is approximately 30% at a refrigeration temperature of 200 K, 20% at a refrigeration temperature of 150 K, 16% at a refrigeration temperature of 100 K, 10% at a refrigeration temperature of 77 K and 8% at a refrigeration temperature of 30 K. This ratio approaches 6.6% below 30 K. Though generation of low temperatures is possible even below 6.6%, the coefficient of performance declines. In a prime mover, the volume of the expansion space approaches 120% that of the compression space as the heating temperature rises.

One example of specifications when refrigeration power is 100 W at 77 K is as follows:

Pulse tube: stainless steel, 3 cm in diameter, 30 cm in length; regenerator: 800 sheets of stainless steel 200 mesh having a diameter of 3.8 cm; volume of compression space: 900 cc; volume of expansion space: 90 cc; rotational speed: 240 rpm; mean operating pressure (He): 17.5 ata; phase difference: 21°; minimum temperature attained: 32 K; input: 3.3 kW; performance index: 3300/100=33; coefficient of performance: 1/33=0.03.

When efficiency is expressed as the Carnot value, we have $\eta\%=(300-77)/77/33*100\%=8.8\%$. This value is approximately the same as that of a Gifford-McMahon cycle refrigerator having the same output power.

It is evident that the efficiency of a refrigerator based upon the engine of this invention is very high even though the engine is still in the initial stages of development.

In order to prevent mechanical vibration of the heat absorber 20 from the mechanisms of the expansion space 26 and compression space 13, the cold piping **22*a* and 22*b* shown in FIG. 3 should be made flexible piping having a length of 1–2 m. This is effective in eliminating vibration. However, if the lengths of the flexible pipes are made too large, the dead volume within the piping will increase. In addition, there will be a decline in the compression ratio of the fluid within the compression space 13** owing to pressure loss caused by the excessive length. As a consequence, refrigeration output declines with an increase in piping length. However, several microns to several tens of microns of mechanical vibration of the heat absorber, which vibration appears also in refrigerators of other cycles, can be completely eliminated through use of the flexible piping and by dispensing with the need for movable mechanisms such as low-temperature pistons near the heat absorber.

In a prime mover, use of the flexible piping reduces efficiency greatly. That is, the shorter the flexible piping the higher the efficiency. Further, in a case where the required refrigeration temperature is less than 30 K, this is readily obtained if the regenerator 19 is filled with a regenerating material consisting of innumerable small lead balls or a rare-earth element and the ratio of the volume of expansion space 26 to the volume of the compression space 13 is reduced. However, the ratio of the volumes diminishes and efficiency decreases by a wide margin with a decline in the required refrigeration temperature. The regenerator 19, heat absorber 20 and pulse tube 21 are radiate-shielded by multiple shielding layers and are insulated by vacuum. In case of a prime mover, however, a cold adiabatic method may be employed.

The volume of the compression space is very large in comparison with that of the expansion space. Therefore, if the volume of the compression space 13 is split into two portions and two compression pistons which form this compression space are arranged and driven in horizontally opposed fashion, as is done in a Stirling engine, the changes in the volumes of these two compression spaces will be in phase. As a result, vibration of the low-temperature compression section can be reduced even further by virtue of the excellent mechanical dynamic balance. Furthermore, it can readily be appreciated that if a plurality of heat engines according to the present invention are manufactured in assembled form, the reduction in vibration will be accompanied by higher efficiency.

In order to operate the engine as a low-temperature prime mover, the fluid is compressed in 10 the expansion space 26 when the engine operates as a refrigerator, the heat absorber 20 is cooled as by a liquified natural gas (the boiling point of methane at one atmosphere is 112 K), and the radiator 18 is heated to 274–373 K by seawater or warm water, whereupon the compression space 13 functions as an adiabatic expansion space and the compression piston 16 performs expansion work. As a result, the crankshaft 14 is rotated. In other words, power is produced. As for the ratio of the expansion space to the compression space at this time, the cycle is reversed to a clockwise cycle, and therefore it will suffice to make the compression space in the case of a refrigerator the expansion space and the expansion space the compression space.

If the heating temperature is assumed to be 373 K, the theoretical efficiency $\eta$ will become $\eta=1-(112/373)=0.7$, and the actual efficiency obtained will be 30%, which is approximately half of this, just as in a Stirling engine. The present invention can be applied to an electricity generating-type evaporator system for evaporating liquified methane and supplying it as municipal gas. This is capable of being put into practical use in place of a Stirling engine.

The advantages of the present invention is comparison with a Stirling engine and other refrigerators will now be set forth.

a) A high operating efficiency is obtained without using a comparatively long displacer or expansion piston reciprocated at low temperature or very high temperature.

b) There are no low-temperature/high-temperature movable portions and no drive mechanisms for these purposes, and therefore dust is not produced by cylinder-piston contact. Accordingly, contamination of the working fluid is eliminated and performance is stable over long periods of time. In addition, reliability is greatly improved with fewer number of mechanical parts.

c) The expansion and compression pistons reciprocate only in the cold portions, and vibration and noise of the cold portions are greatly reduced in comparison with existing engines.

d) In the refrigerator, mechanical vibration which the heat absorber applies to the object to be cooled is completely eliminated. This improves the possibility of application to electronic systems.

e) By virtue of the simplification in the refrigerator structure, an improvement in the reliability of systems to which the refrigerator is applied is expected.

f) Since the present invention does not require low-temperature moving parts, easy manufacture is possible using existing techniques, just as in the case of cold fluidic machinery.

g) In addition to the simpler arrangement of components and the reduction in component parts, there is no need for parts and mechanisms requiring precision machining. As a result, manufacturing cost is greatly reduced and a highly reliable refrigerator and prime mover can be provided at low cost.

h) Since the apparatus can be manufactured as a single cycle or a combination of plural cycles, refrigeration temperature and refrigeration output can be adjusted depending upon the particular application, and it is easy to raise efficiency.

i) Since there is no need for costly manufacturing expenditures and a comparatively long, easy-to-break expansion piston or displacer is eliminated, handling necessary when the apparatus is moved is facilitated. In addition, operation required to run the apparatus is similarly facilitated.

Preferred other embodiments of the present invention will now be described with reference to FIGS. 6–16.

Figure 6:
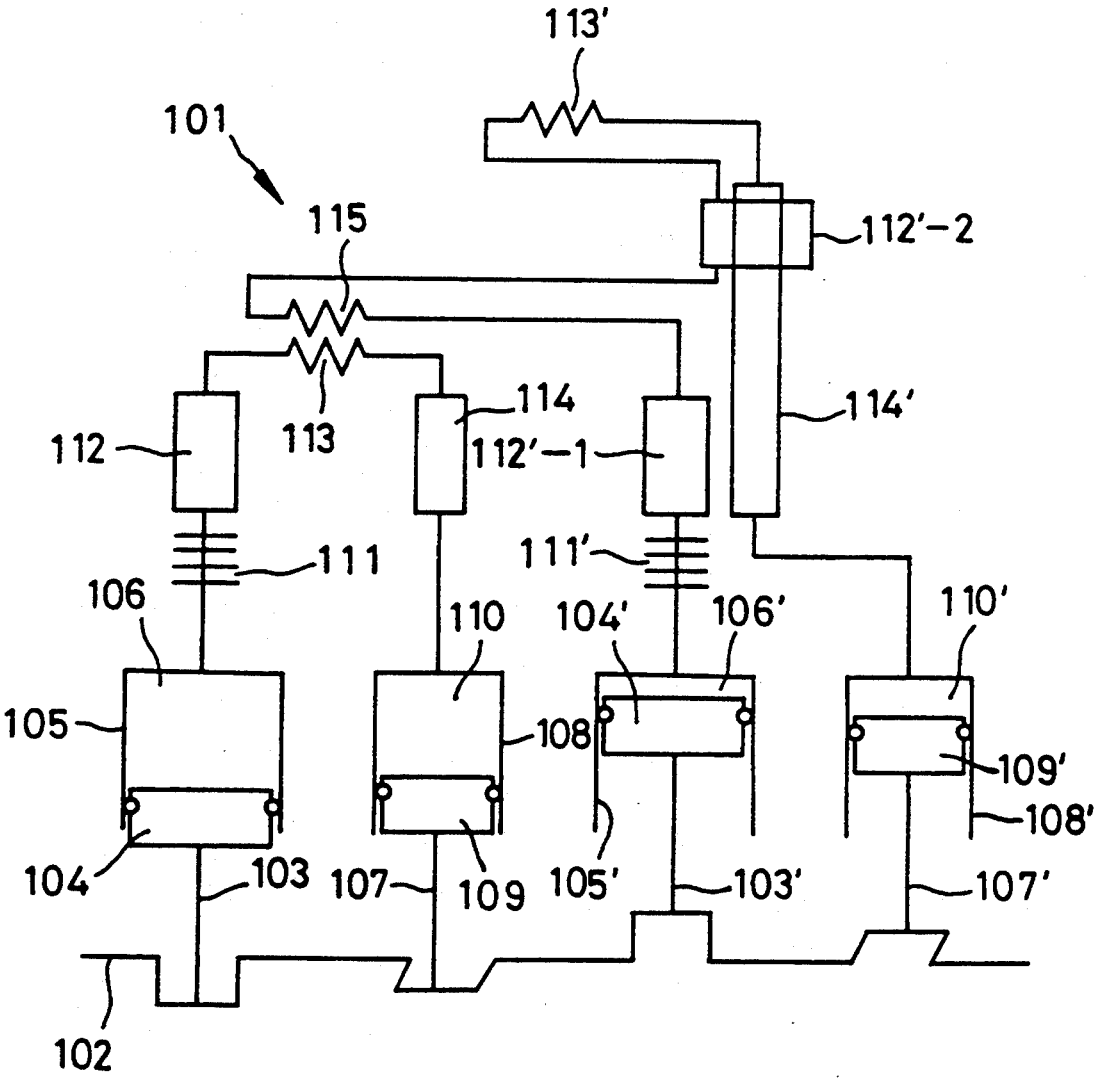
FIG. 6 is a schematic view for describing an embodiment of the present invention.

With reference to FIG. 6, there is shown a pulse tube refrigerator 101 which includes a crankshaft 102, a rod 103 connected to the crankshaft 102, a compression piston 104 reciprocated by the rod 103, a cylinder 105, and a compression space 106 defined within the cylinder 105 by the compression piston 104. The refrigerator 101 further includes another rod 107 connected to the crankshaft 102, a cylinder 108, a expansion piston 109 reciprocated within the cylinder 108, and an expansion space 110 defined within the cylinder 108 by the expansion piston 109. The volume of the expansion space 110 is varied by reciprocation of the expansion piston 109.

The expansion space 110 is placed in a cold state, and the crank angles of the two rods 103 and 107 are selected in such a manner that the change in the volume of the compression space 110 will lead the change in the volume of the compression space 106 at a constant phase difference within a range of 10°45°. Preferably, the phase difference is made 20°–30°.

The expansion space 106 communicates with the expansion space 110 via a radiator 111, regenerator 112, cold head 113 and pulse tube 114. The regenerator 112 is filled with a regenerating material such as a stainless-steel or bronze mesh, group of small lead balls or a rare-earth element. The section thus constructed constitutes a first thermal system.

A second thermal system is constructed in parallel with the first thermal system. The second thermal system similarly is constituted by a radiator 111', a regenerator, cold head 113' and pulse tube 114'. However, as will be appreciated from FIG. 6, the regenerator of the second thermal system differs from that of the first thermal system in that it comprises two sections 112'-1 and 112'-2.

The first and second thermal systems are interconnected in such a manner that a heat exchange 115 is performed between the cold head 113 of the first thermal system and the portion of the second thermal system that is between the two regenerator sections 112'-1, 112'-2. The connection allows the low temperature of the cold head 113 in the first thermal system to be transferred to the working fluid of the second thermal system so that it is possible to produce very low temperature in the second thermal system.

The embodiment of FIG. 7 will now be described, in which components identical with those in the embodiment of FIG. 6 are designated by like reference numerals and need not be described again.

Figure 7:
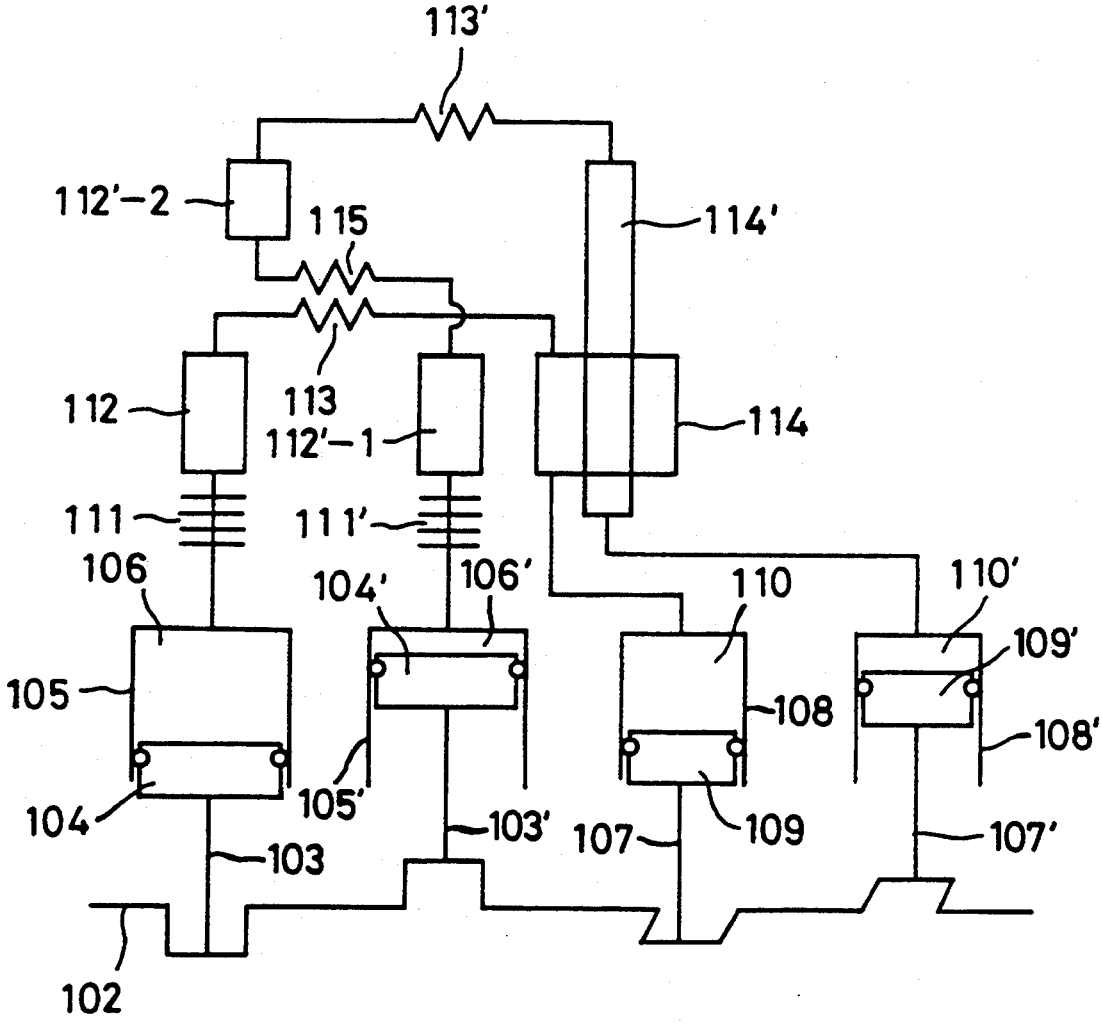
FIG. 7 is a schematic view for describing another embodiment of the present invention.

In contrast with the embodiment of FIG. 6, the embodiment shown in FIG. 7 differs in that the two compression pistons 104, 104' are arranged side by side, as are the two expansion pistons 109, 109', and the pulse tubes 114, 114' of the two thermal systems are arranged in concentric relation. However, the basic operation is the same in both FIG. 6 and FIG. 7.

Figure 8:
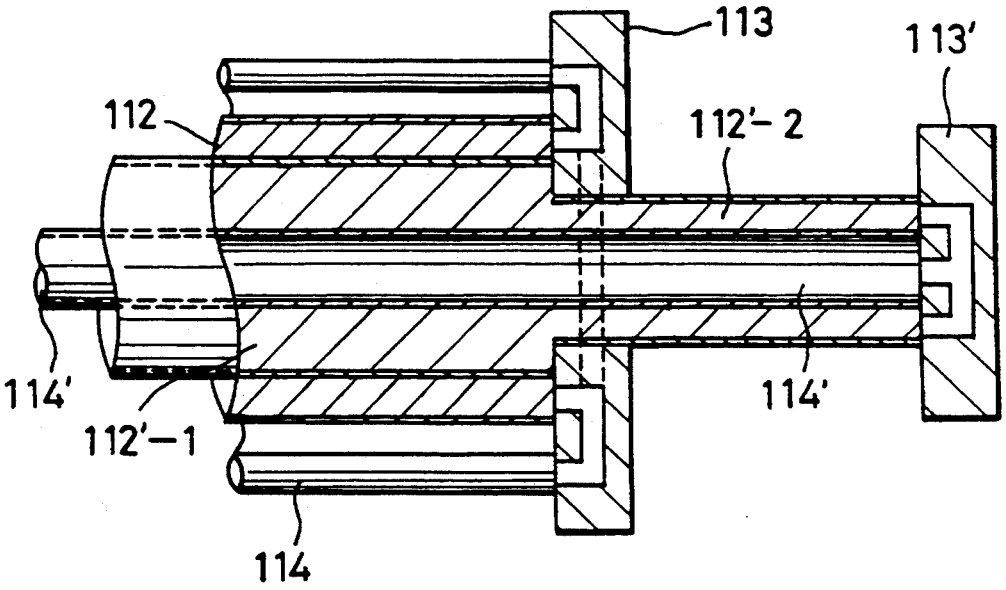
FIG. 8 is a sectional view illustrating the detailed construction of an embodiment of the present invention.

FIG. 8 illustrates the detailed arrangement of the elements constructing the apparatus shown in FIG. 6. The regenerator sections 112'-1, 112'-2, the regenerator 112 and the pulse tube 114 are arranged substantially symmetrically in cylindrical form about the pulse tube 114' of the second thermal system. As a result, the two thermal systems can be constructed in compact form.

Figure 9:
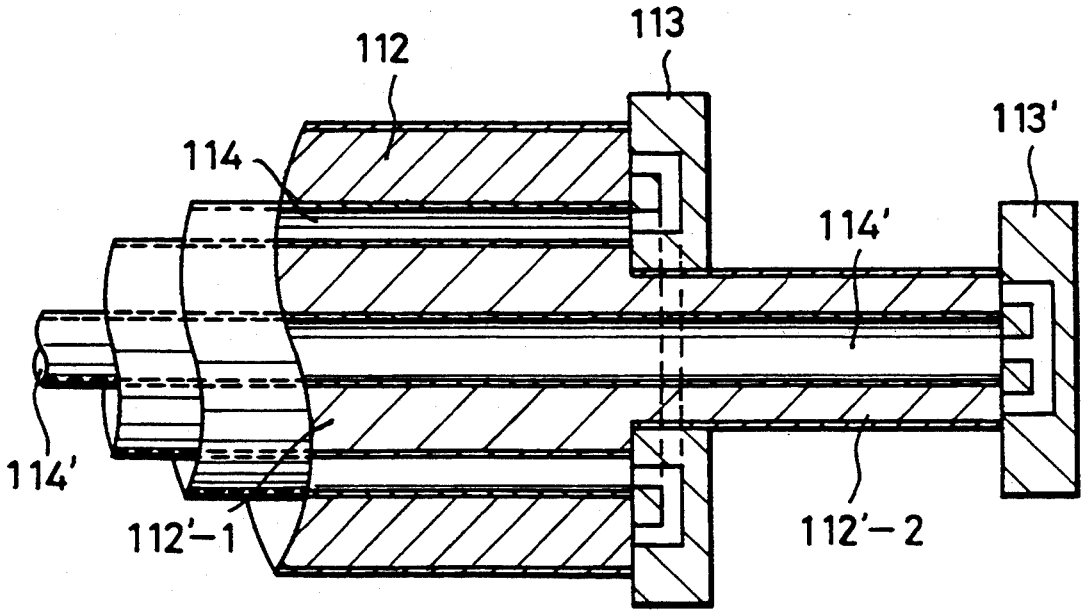
FIG. 9 is a sectional view illustrating the detailed construction of another embodiment of the present invention.

FIG. 9 illustrates the detailed arrangement of the elements constructing the apparatus shown in FIG. 7. Here also the regenerator sections 112'-1, 112'-2, the regenerator 112 and the pulse tube 114 are arranged substantially symmetrically in cylindrical form about the pulse tube 114' of the second thermal system. The cold head 113 of the first thermal system undergoes a heat exchange 115 with the two regenerator sections 112'-1, 112'-2 of the second thermal system. This arrangement is useful in that the two thermal systems can be configured more compactly.

Figure 10:
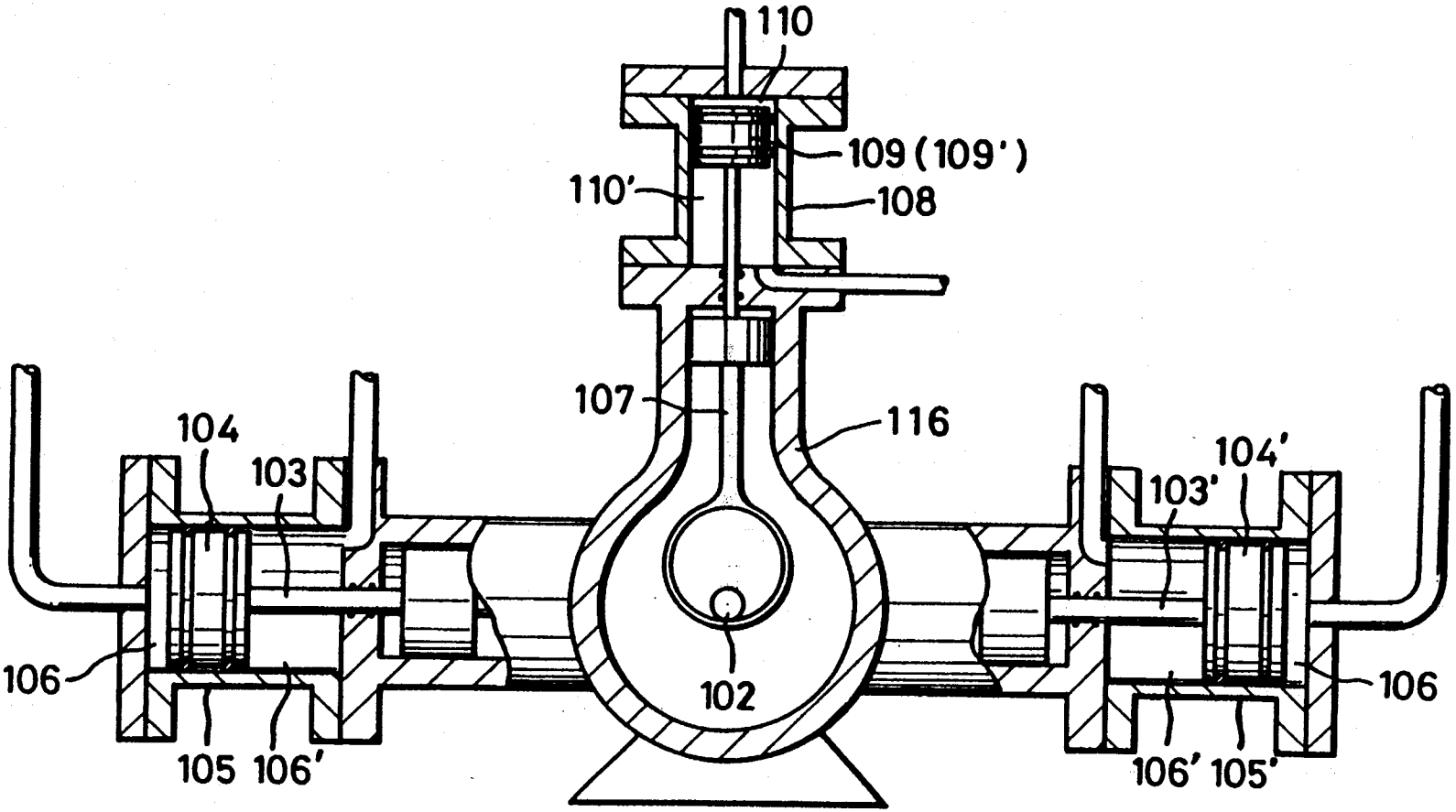
FIG. 10 is a longitudinal sectional view showing a crankshaft.
Figure 11:
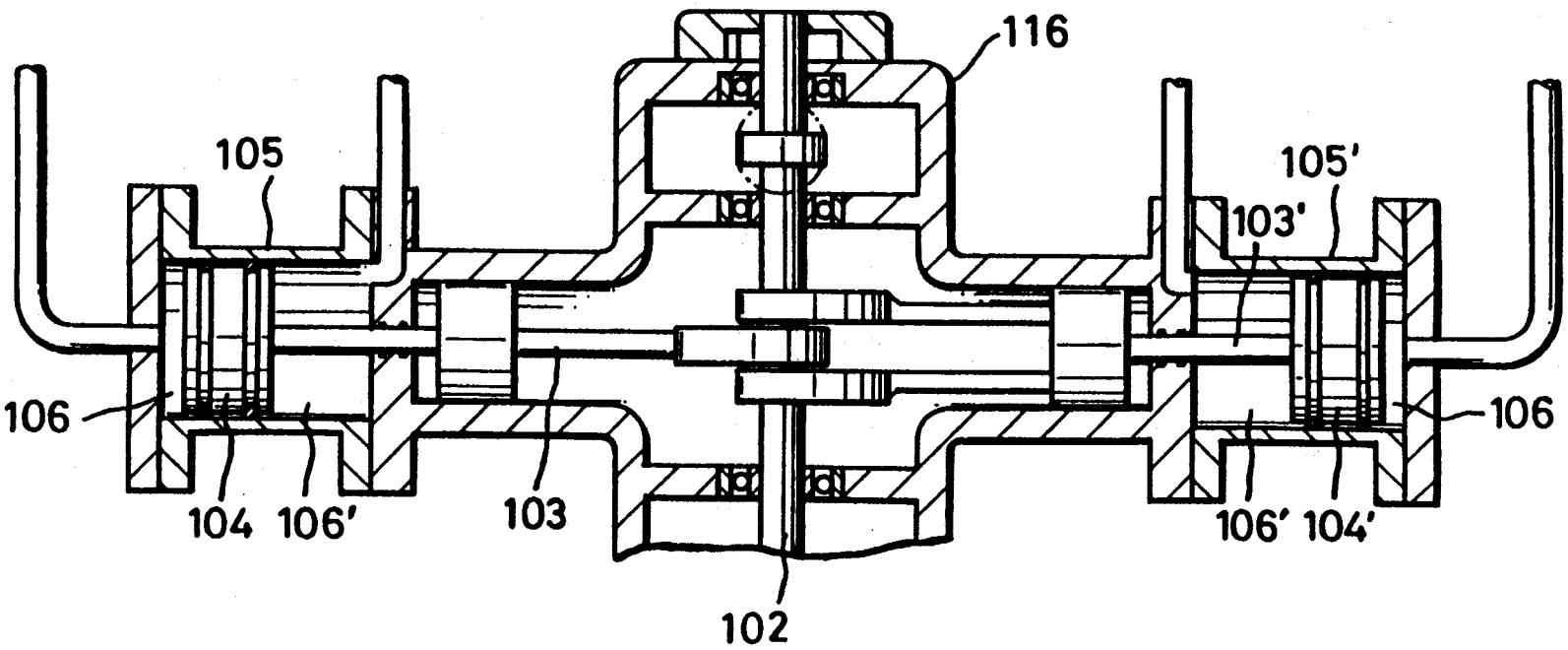
FIG. 11 is a transverse sectional view showing the crankshaft.

Thus, FIGS. 8 and 9 illustrate preferred examples of detailed arrangements of the regenerators and pulse tubes. FIGS. 10 and 11 illustrate a detailed arrangement of components surrounding the crankshaft 102.

As illustrated in FIGS. 10 and 11, two double-acting pistons 104, 104' are arranged in horizontally opposed fashion to form four compression spaces 106, 106, 106', 106'. The compression spaces 106, 106, which operate in phase, are communicated with each other. Similarly, the compression spaces 106', 106', which operate in phase, are communicated with each other.

The expansion piston 109 is housed in the same crankcase 116 to form two expansion spaces 110, 110'. The crank angles of the rods 103, 103', 107 reside within a range of 10°–45°.

As evident from FIGS. 10 and 11, the two compression pistons 104, 104', the two expansion pistons 109, 109' and the rods 103, 103', 107 can be housed in the same crankcase 116, and flexible tubing connected to the compression and expansion spaces is connected to the regenerators and pulse tubes of FIGS. 8 and 9, thereby making it possible to construct a compact refrigerator.

It is preferred that the phase angles between each of the compression pistons 104, 104' and each of the expansion pistons 109, 109' be a combination of the same or different angles, and that the volumes of the expansion and compression spaces be made variable so that low temperature expected at the cold head may be obtained. This variation in volume is made possible by selecting the angle of the crank portion with respect to the crankshaft.

Figure 12:
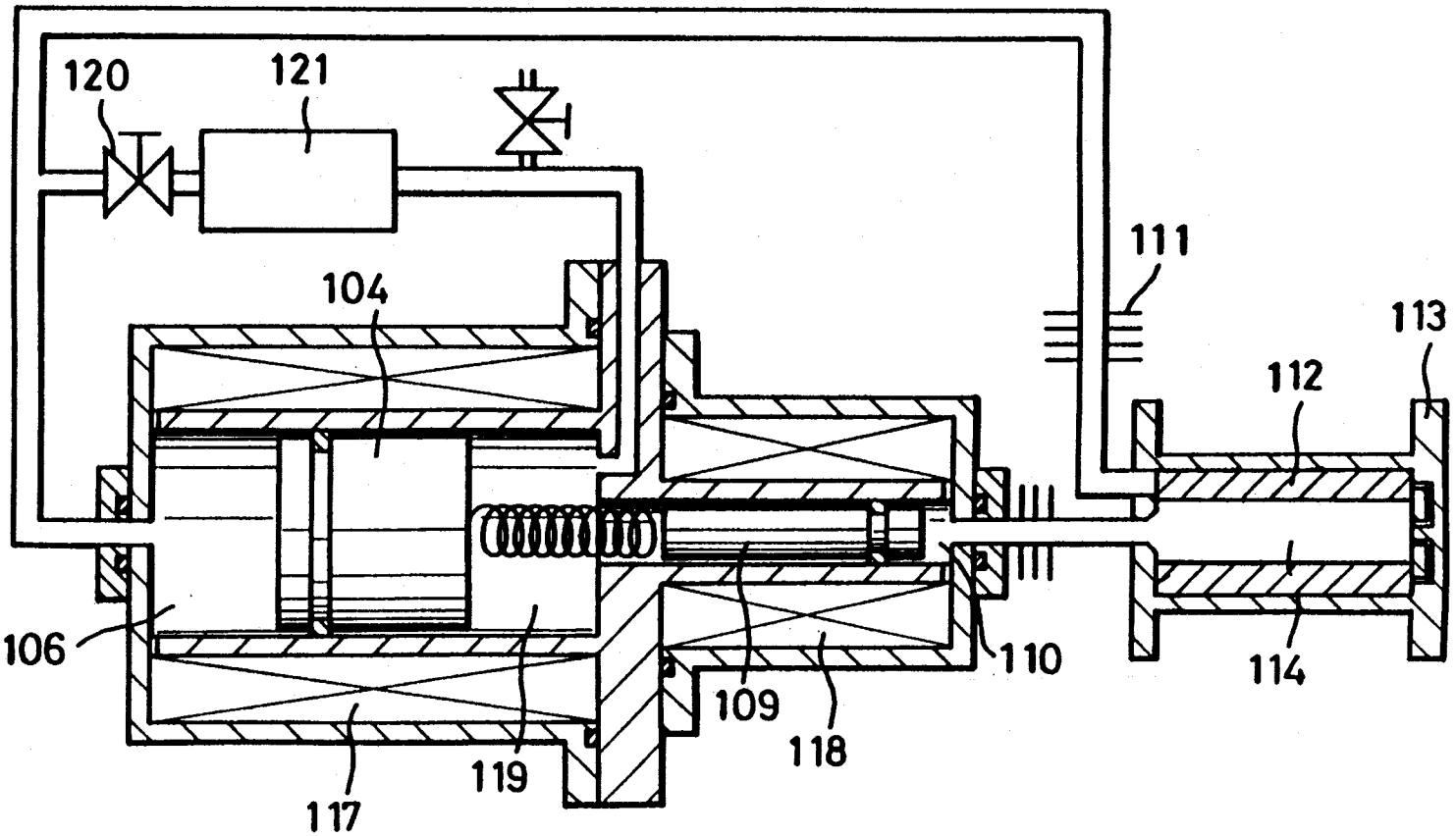
FIG. 12 is a sectional view showing an example in which a linear motor is used.
Figure 13:
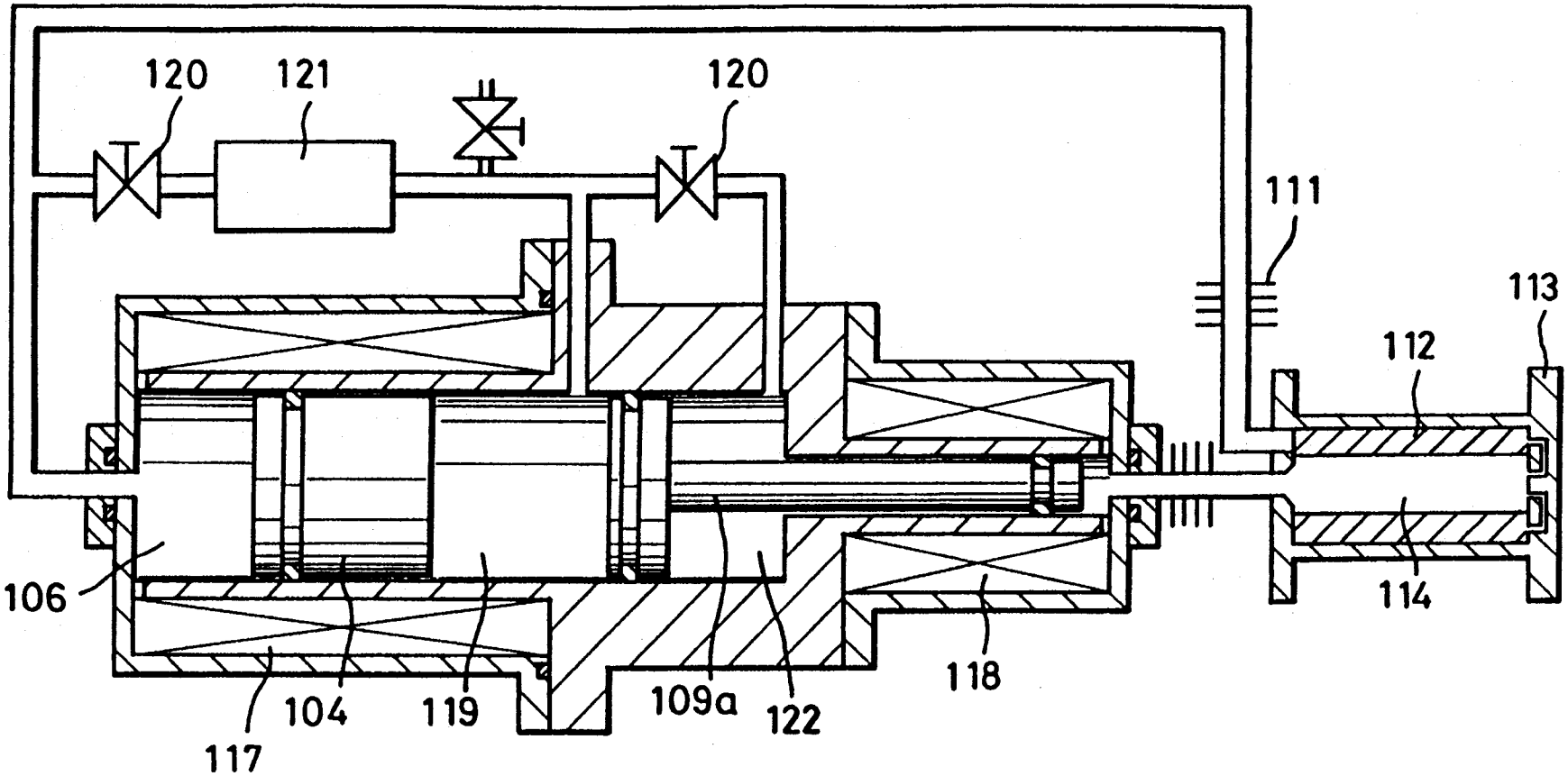
FIG. 13 is a sectional view showing another example in which a linear motor is used.

FIGS. 12 and 13 illustrate examples in which, rather making use of the crankshaft 102, the two pistons 104 and 109 are reciprocated using linear motors 117 and 118. Feed of current to the two linear motors 117 and 118 is controlled in such a manner that the expansion piston 109 will lead the compression piston 104 by a phase angle of 10°–45°.

A buffer tank 119 is provided on the side of the compression piston 104 that is opposite the compression space 106. The compression space 106 and the buffer tank 119 are communicated with each other by a flexible tube having a control valve 120 and a filter 121. The control valve 120 and filter 121 improve the purity of the working fluid by eliminating impurities contained in the working fluid, and they also function to manage the pressure of the working fluid.

In the example shown in FIG. 13, a T-shaped piston **109*a* is used as the expansion piston to form a second buffer tank 122. Movement of the pistons 104, 109, 109*a*** can be limited by position sensors.

Arrangements of the kind shown in either FIG. 12 or 13 may be placed side by side and the cold heads 113 of the respective stages may be shared (as by disposing the cold heads 113 in cylindrical form about a common center) so that the identical cold temperature can be produced by one large cold head. Further, as depicted in FIGS. 6 and 7, the cold head 113 may be used to pre-cool another low-temperature producing system so that a heat exchange may be performed with the other low-temperature producing system at this portion.

In all of the embodiments and examples described above, the volume of the expansion space preferably is 6.6% to 30% that of the compression space. The necessary volume of the compression space may be acquired by using several compression pistons.

Figure 14:
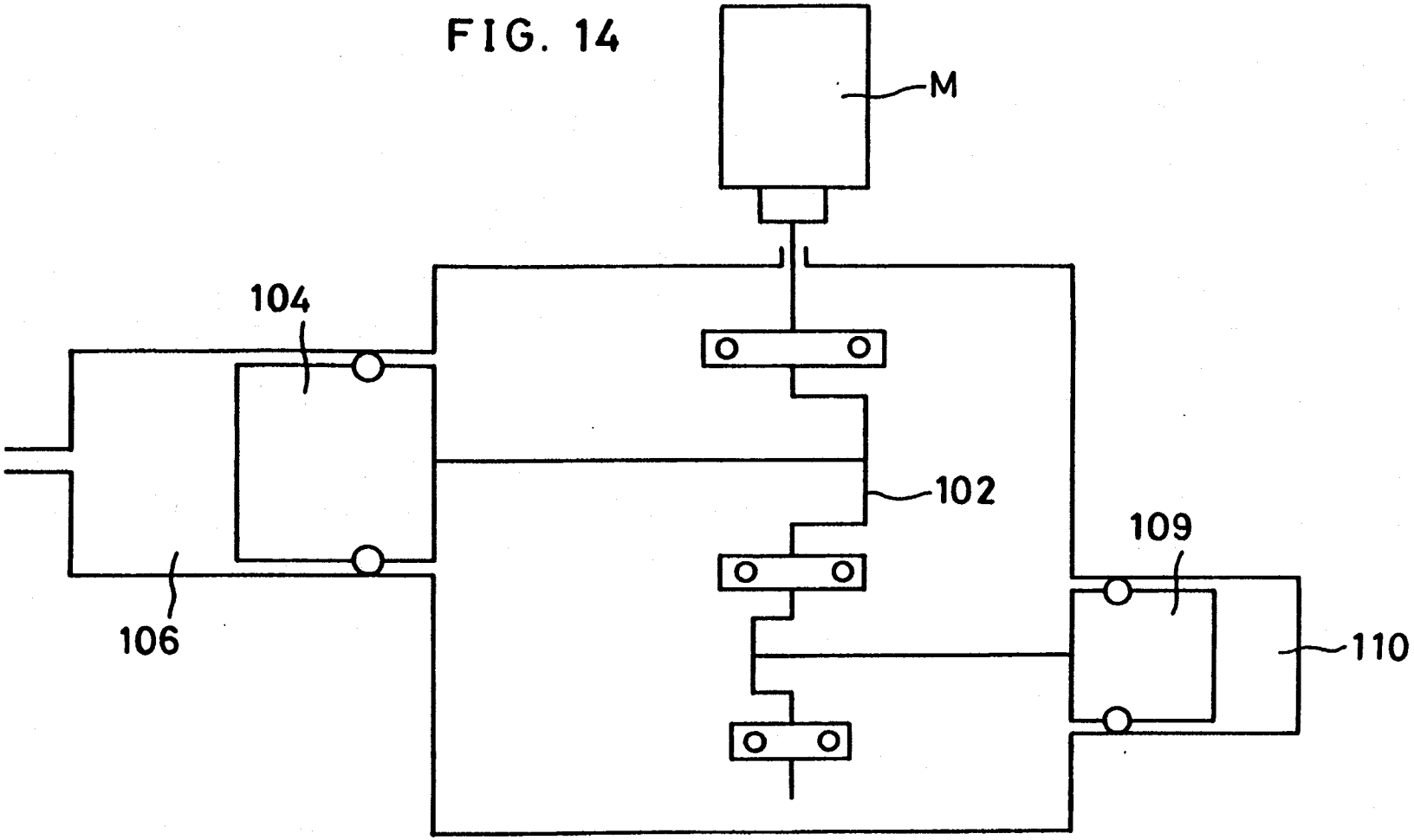
FIG. 14 is a plan view showing an example in which the crankshaft is applied to the arrangement of FIG. 12.

Though the two pistons 104, 109 are operated using the linear motors 117, 118 in the examples of FIGS. 12 and 13, it is permissible to adopt an arrangement of the kind shown in FIG. 14, in which the two pistons 104, 109 are reciprocated using the crankshaft 102 and a motor M instead of the linear motors 117, 118.

Figure 15:
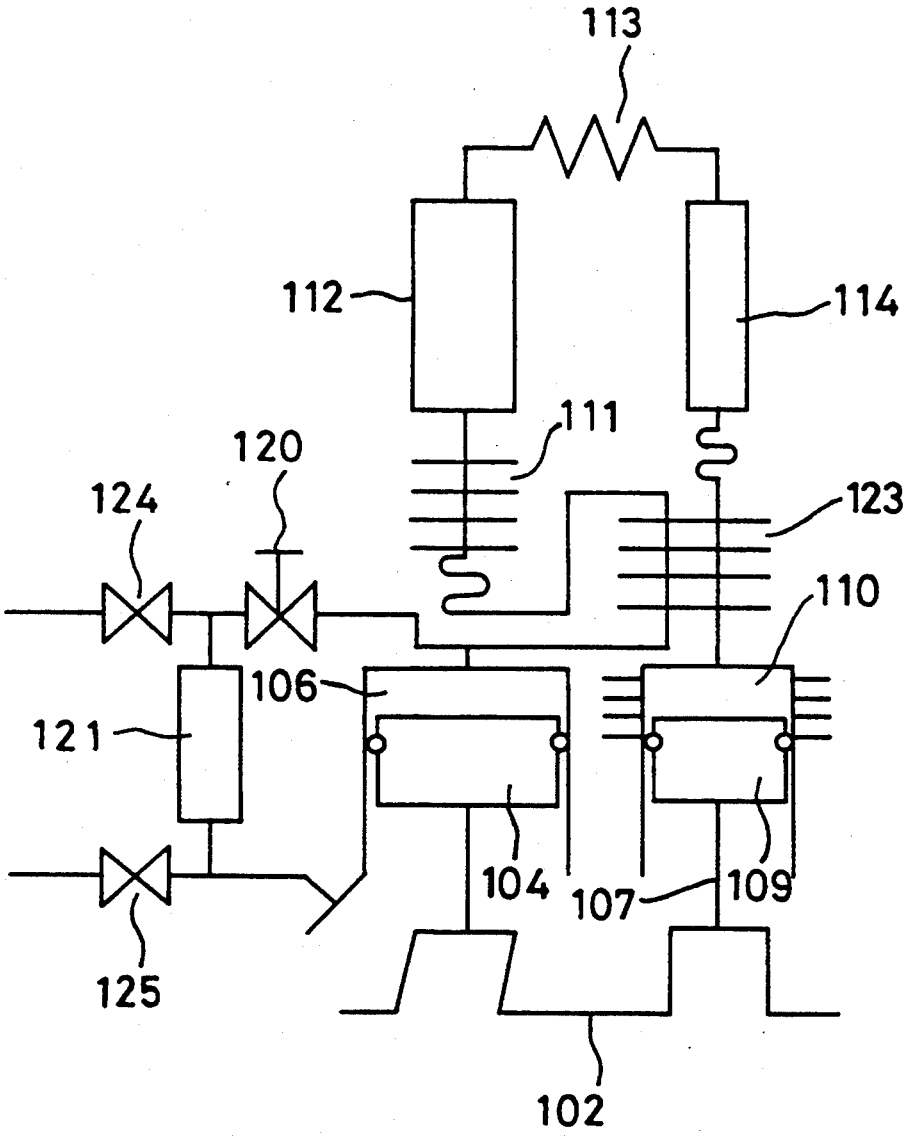
FIG. 15 is a schematic view for describing still another embodiment of the present invention.

Still another embodiment of the invention, shown in FIG. 15 is effective in preventing the temperature of the expansion space from falling below the ordinary (cold) temperature when the expansion work of the expansion space 110 increases. (For example, if the refrigeration temperature is 80 K and the expansion work is greater than 50 W, the temperature of the expansion space will fall to about 250 K unless the heat-radiating effect is adequate.)

As shown in FIG. 15, heat from the compression space 106 is transferred to the working fluid in the expansion space 110 using a radiator 123, thereby preventing a drop in the temperature of the expansion space 110. Components in FIG. 15 identical with those in the other embodiment are designated by like reference numerals.

In order to supply the compression space 106 with a working fluid of high purity, the filter 121 should be disposed between a pressurizing valve 124 and a depressurizing valve 125. By adopting such an arrangement, the working fluid from the crankcase will be supplied to the compression space 106 as a high-purity working fluid via the filter 121 and pressure-control valve 120.

Figure 16:
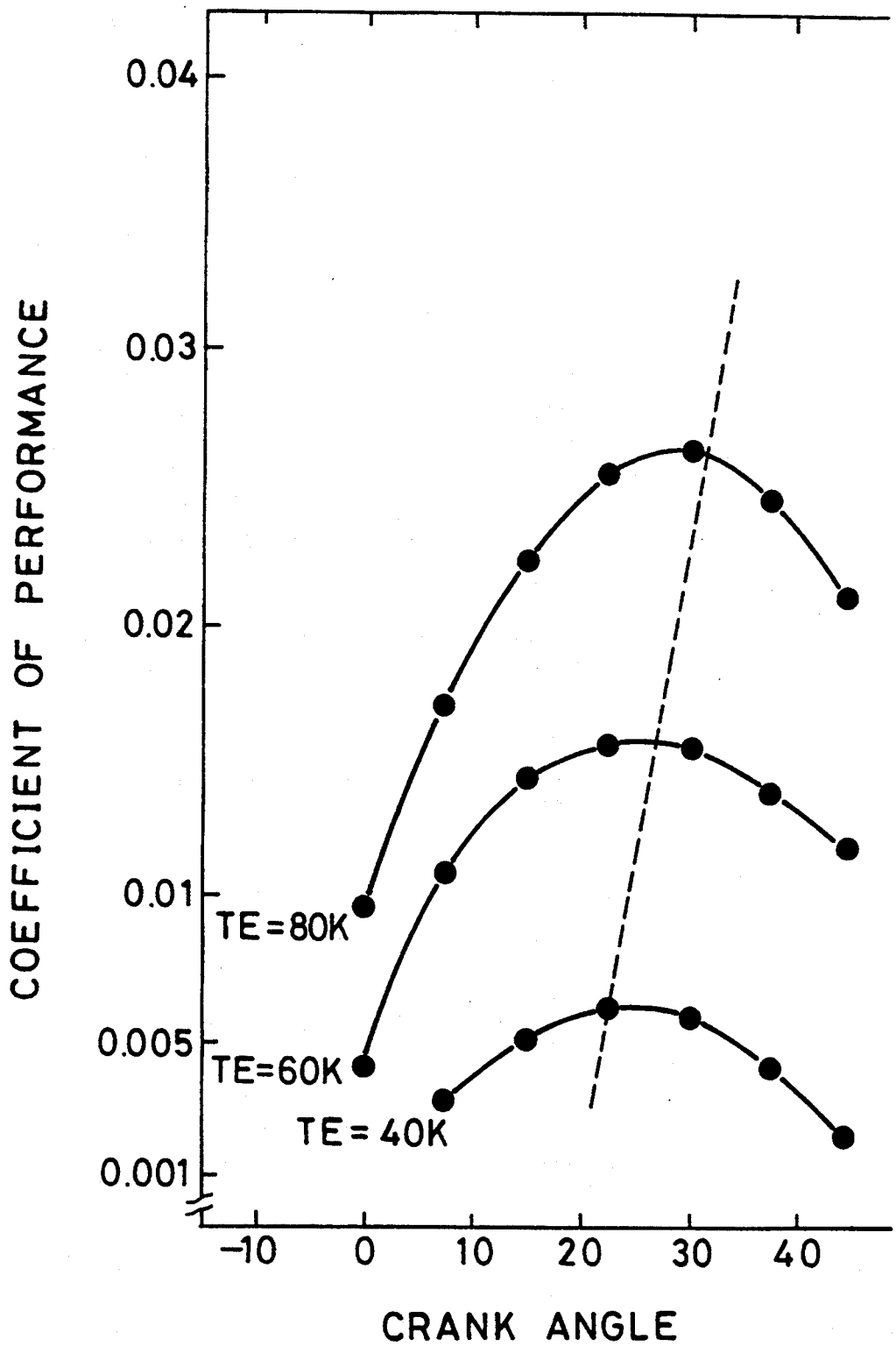
FIG. 16 is a graph showing the relationship between crank angle and coefficient of performance.

FIG. 16 is a graph showing the relationship between crank angle and coefficient of performance. When refrigeration temperature TE is made constant at 80 K and the crank angle is increased from 0° to 30° in the embodiment of FIG. 1, the coefficient of performance (the ratio of refrigeration output to consumed power) rises from 0.01 to 0.027. At 40 K, the maximum coefficient of performance is attained when the crank angle is 22°. As evident from FIG. 16, an optimum crank angle conforming to refrigeration temperature exists, and this value resides within a range of 20°–30°.

In accordance with the present invention, low-temperature moving parts are no longer necessary, i.e., the expansion piston is placed at ordinary temperature. As a result, manufacture and maintenance are facilitated. In addition, since the refrigerator can be provided with a plurality of cycles, the refrigeration output can be adjusted to conform to the particular application. In addition, the practical refrigeration performance of the apparatus is raised in comparison with the prior art.

Other features and advantages of the present invention will be apparent from the following description taken in conjunction with the accompanying drawings, in which like reference characters designate the same or similar parts throughout the figures thereof.

What is claimed is:

1. A pulse tube heat engine comprising a compression space, a radiator, a regenerator, a heat absorber, a pulse tube and an expansion space, wherein said radiator, said regenerator, said heat absorber and said pulse tube are connected between said compression space and said expansion space of a working fluid, and a variation in the volume of said expansion space is advanced by a constant phase difference within a range of phases of from 0° to +60° relative to a variation in the volume of said compression space.

2. The heat engine according to claim 1, wherein said heat engine operates as a prime mover, with the volume of said expansion space being within a range of from 6.6 to 30% of the volume of said compression space.

3. The heat engine according to claim 1, wherein said heat engine operates as a refrigerator, with the volume of said compression space being within a range of from three times to 15 times the volume of said expansion space.

4. A pulse tube refrigerator comprising:

first and second compression spaces, each defined by a compression piston inside a cylinder;

first and second expansion spaces, each defined by an expansion piston inside a cylinder, at least one of said expansion pistons being reciprocated at an advance angle of a constant phase difference within a range of 10°–45° relative to a corresponding one of said compression pistons; and first and second thermal systems respectively communicating the first and second compression and expansion spaces and each having a radiator, a regenerator, a cold head and a pulse tube, wherein a heat exchange is performed between the cold head of said first thermal system and said second thermal system.

5. The refrigerator according to claim 4, wherein said second thermal system comprises a pair of regenerator sections, and the heat exchange with the cold head of said first thermal system is performed between said pair of regenerator sections.

6. In a pulse tube refrigerator having a couple of low thermal systems which are connected in heat exchangable relation with each other and each has a compression space, a radiator, a regenerator, a cold head, a pulse tube and an expansion space, the regenerator and the pulse tube of a first thermal system are axially arranged in a cylindrical form and connected by the cold head of the first thermal system, and the regenerator and the pulse tube of a second thermal system are axially arranged in a cylindrical form about the pulse tube of said first thermal system and connected by the cold head of the second thermal system.

7. In the pulse tube refrigerator according to claim 6, further comprising:

two horizontally opposed double acting compression pistons arranged to form four compression spaces and connected to each other by a crank shaft so as to move with the same phase angle; and an expansion piston connected to said crank shaft so as to move with said compression pistons, but at a phase angle with respect thereto, the expansion piston forming two expansion spaces.

8. A refrigerator having a relatively large volume compression space, an expansion space arranged in horizontally opposed form with respect to the compression space, a radiator, a regenerator, a cold head, and a pulse tube, both the spaces being communicated by a flexible tube and pistons defining said spaces being operated in synchronism with each other at a constant phase angle within a range of 10°–45°.

* * * * *